US009739083B2

(12) United States Patent
Hermann

(10) Patent No.: US 9,739,083 B2
(45) Date of Patent: Aug. 22, 2017

(54) MEDICINAL SAFE, LOCKABLE IN A MEDICINE CABINET

(71) Applicant: Jeffrey Hermann, Purchase, NY (US)

(72) Inventor: Jeffrey Hermann, Purchase, NY (US)

(73) Assignee: Solo Technology Holdings, LLC, Purchase, NY (US)

( * ) Notice: Subject to any disclaimer, the term of this patent is extended or adjusted under 35 U.S.C. 154(b) by 0 days.

(21) Appl. No.: 14/631,680

(22) Filed: Feb. 25, 2015

(65) Prior Publication Data

US 2016/0037916 A1 Feb. 11, 2016

Related U.S. Application Data

(60) Provisional application No. 62/034,305, filed on Aug. 7, 2014.

(51) Int. Cl.

| | |
|---|---|
| ***E05G 1/024*** | (2006.01) |
| ***E05G 1/00*** | (2006.01) |
| ***A47B 67/02*** | (2006.01) |
| ***E05B 65/00*** | (2006.01) |

(Continued)

(52) U.S. Cl.

CPC ..... *E05G 1/005* (2013.01); *A47B 67/02* (2013.01); *E05B 65/0014* (2013.01); *E05B 65/0075* (2013.01); *E05G 1/024* (2013.01); *E05G 1/026* (2013.01); *E05G 1/04* (2013.01); *A47B 2067/025* (2013.01)

(58) Field of Classification Search

CPC E05G 1/005; E05G 1/02; E05G 1/024; E05G 1/026; E05G 1/04; A47F 5/0018; G07G 1/0018

See application file for complete search history.

(56) References Cited

U.S. PATENT DOCUMENTS 2,997,354 A * 8/1961 Hough ..... A47B 67/02 292/162

3,008,785 A * 11/1961 Gehrs ..... A47B 67/005 292/DIG. 65

(Continued)

FOREIGN PATENT DOCUMENTS

CN 203742356 U 7/2014

WO PCT/US2015/021792 6/2015

*Primary Examiner* — Christopher Boswell

(74) *Attorney, Agent, or Firm* — Andrew S. Langsam; Pryor Cashman LLP

(57) ABSTRACT

The present invention is a preferably rectangular sturdy, yet plastic, compartment or safe, small enough to fit inside a medicine cabinet, but large enough to house pill bottles and other medications. The safe has an openable and lockable front door that preferably comprises the safe's front wall. The safe also has laterally expandable side wings that also can be reduced inwardly to the width of the safe or expand beyond this size to contact and grip the interior sidewalls of the medicine cabinet. The wings are able to be locked in the chosen position. They are also preferably shaped to secure themselves and the safe inside a medicine cabinet. The safe door and the wings are lockable by a number of mechanisms, most preferably via a wireless signal transmitted from a device controlled by a local wireless network or internet enabled device. The wings and the front door are meant to lock and unlock together for security.

4 Claims, 4 Drawing Sheets

(51) Int. Cl.
*E05G 1/026* (2006.01)
*E05G 1/04* (2006.01)

(56) References Cited

U.S. PATENT DOCUMENTS

| | | | | | |
|---|---|---|---|---|---|
| 3,146,739 | A * | 9/1964 | Furman | A47B 63/00 | 109/52 |
| 4,577,563 | A * | 3/1986 | Sidler | E05G 1/005 | 109/52 |
| 4,663,621 | A * | 5/1987 | Field | A61B 19/0248 | 221/154 |
| 5,170,907 | A * | 12/1992 | Sakai | E05G 1/005 | 109/52 |
| 5,778,805 | A * | 7/1998 | Green | E05B 65/0075 | 109/51 |
| 6,883,440 | B1 * | 4/2005 | Correia | E05B 17/2038 | 109/59 R |
| 2002/0124779 | A1 * | 9/2002 | Perkins | E05B 37/20 | 109/47 |
| 2006/0169471 | A1 * | 8/2006 | Rupert | H02G 3/185 | 174/50 |
| 2009/0015121 | A1 | 1/2009 | Sampson | | |
| 2012/0200211 | A1 | 8/2012 | Yanni | | |
| 2012/0262039 | A1 | 10/2012 | Daugbjerg | | |
| 2014/0083338 | A1 | 3/2014 | McAlexander | | |
| 2015/0000571 | A1 * | 1/2015 | Stemen | E05G 1/005 | 109/23 |

* cited by examiner

MEDICINAL SAFE, LOCKABLE IN A MEDICINE CABINET

FIELD OF THE INVENTION

The present invention relates to a lockable container or a small safe for prescription pills, preferably held in one's home medicine cabinet, which is however convenient to travel with and protects the pills from theft. The safe has a compartment for medications or other items and has a lockable front door to keep others out, and laterally extendable side wings that ensure that someone other than the owner cannot remove the entire safe from its location for gaining access at another location, with available tools and time. The compartment door can be easily locked or unlocked by key, combination, fingerprint identification, or, most preferably, by instructions obtained via a wireless network connection, depending on the model of the product. The expandable wings can be compressed to the size of the holding compartment to make the product small enough for traveling, or expanded up to the length required to secure the safe in a specific location, preferably between the inside vertical walls of the home medicine cabinet. The wings are configured and shaped to hold the safe in position. For example, in one embodiment the wings are L-shaped so that the safe cannot be moved forwardly without catching on the interior vertical sidewall lip of the cabinet. The owner can control the overall wingspan by manually expanding or compressing them or, in preferred embodiments, by turning a knob or connecting gear connected to attached teeth of the side wings. Once the owner has expanded the wings to the proper width, they can be easily locked in position to ensure that only the owner can adjust them and thus only the owner can remove the safe from the medicine cabinet. In some embodiments, the mechanism which locks the wings in place is connected, either mechanically or electronically, to the lock on the front door of the compartment. In other embodiments, the wings are locked by a screw or mechanism. The product preferably can also communicate with other devices such as a mobile phone. This embodiment allows the compartment to be accessed from afar or to retain and then send a record of its use via a wireless network, a so-called Internet of Things.

BACKGROUND

Medications have an immense influence on our health and day to day lives. Because of this impact they can be some of our most important possessions and keeping them safe is a priority. Due to the high cost of many medications, some who take medications are concerned about medication theft. Some medications can be extremely expensive, either at the pharmacy or in a second hand market, and these medications become targets for thieves who can sell the medications for profit. Medication theft is a serious issue because not only does it deprive the original owner of his property, it puts his health at risk. Even further, stolen medication often ends up in the hands of those who have not been prescribed or recommended a certain drug. These individuals might then take the medication incorrectly, in situations where it is not advised, or for effects for which it is not intended or recommended. These unauthorized uses of medications can harm the user. For example, they can result in worsening conditions if the medication interacts with a preexisting condition or if the user delays reliable medication in place of self medication. These unauthorized uses can also lead to sickness if the medication has unmonitored side effects.

Further, in the case of medications used recreationally, the user can overdose or become dependent. Sadly, in many of these situations, misused medications can even result in death. For these reasons, it is extremely important that medications remain in the hands of the intended recipient. It is in the best interest, not only of the rightful owner of the medication, but also of those ultimately taking the medication, that they are maintained and kept safe.

This concern about theft can cause individuals to hide medications, which makes it more difficult for the intended user to access their own medications. However, preventing theft seems to require that the medications be kept not only somewhere accessible and discrete, but also somewhere fixed and secure, such as a safe or locked cabinet. While this may solve the problem temporarily, a fixed storage spot will not protect the medications during travel away from home, i.e., when the user is away from home for an extended period. Unfortunately, this is often when medications and other possessions are most vulnerable. Taking medications out of the home is unavoidable for some users. For example, individuals who take medications everyday must take them with them every time they travel. Individuals who take medications throughout the day, or at a certain time of day, might need to take medications with them whenever they leave the house. In these situations, keeping medications safe outside of the house is important, too, and can be crucial.

Keeping medications safe from theft is not a user's only concern though. Medications can also be one of the most sensitive items in a home and so for some, keeping medications private and protected is also a priority. For example, certain medications can indicate that the owner has a specific, perhaps embarrassing or at least confidential, medical condition or a medical condition that could cause others to worry. In these situations, owners will likely prefer to keep their medications private.

Yet, in many situations, people need to access medications daily, and/or quickly or when they are weakened and so it is important that these medications are easy to access. The objectives of keeping medications both safe and private, possibly transportable and having them easy to access are sometimes at odds. For example, to ensure accessibility, many people keep their medications in an obvious and unobstructed location, such as on the bathroom counter or in a medicine cabinet, on a bedside table, or a kitchen counter. These obvious locations prevent users from forgetting where they put their medication and help them to take their medications easily in a daily routine. For example, if a person takes a medication every morning, he might leave the medication in a bathroom medicine chest where he can take the medication immediately before or after brushing his teeth and getting ready for the day. Another might leave the medications on a kitchen counter to be taken daily with milk, coffee or meals. Still another might leave them at his bedside to be taken as soon as he wakes up or before he falls asleep. These obvious locations are out in the open so that individuals do not waste time scrambling for the medications when it comes time to take them, but it also leaves them out in the open for prying eyes to see and possible falling into the wrong hands, whether a toddler, teen, or another. To keep medications secure, one will usually keep medications somewhere out of the way or even go so far as to hide them. This can be inconvenient for daily use however since it often requires scrambling for the medications to find them. For example, a common place to put private items is in a drawer. Then, to obtain the items, a person must first move the other items in the drawer. This can be time consuming and stressful if the items are not found right away. Another common hiding place is on a high shelf out of reach. Then, to obtain the items a person must find a step stool or small ladder to get the items down. Further, in the event of an emergency, it makes the medications more difficult for caregivers to find and obtain. A caregiver might not know where a hidden, and in some cases life saving, medication is and this hiding for safety against others' improper use can cause unnecessary delays in treatment.

For these reasons and others, it would be advantageous to have a container that could be placed in an accessible location while still maintaining privacy and safekeeping. A lockable and discrete safe that can be secured in a typical location, such as a medicine cabinet, would solve the issues listed above. Even further, it would be advantageous if the lockable safe is removable and portable, capable of easy travel, and even able to be secured again, in a second location. Even further, it would be advantageous to have a medicine-holdable safe that is accessible via a secure wireless connection from a local network or mobile or smartphone device that provides quick access and an emergency override.

Description of Prior Art

To the Applicant's knowledge, no safe exists that will house medicine and pill bottles discretely in a lockable and secured container that is also portable and able to be secured again while traveling. Thus, it is advantageous to provide a safe which contains all of these attributes, in a small and lightweight manner with an option for electronic communication with other devices or to identify the user, for the purpose of privately storing and protecting medications in an easy to access permanent, semi-permanent, or movable location.

SUMMARY OF THE INVENTION

The present invention is directed to a safe that is able to fit inside of a medicine cabinet, with expandable lateral side wings, and a lockable front door. The safe contains two side walls in addition to top and bottom walls, front and back panels, and an openable front door. The door can be locked by any means including a key, a combination, a wireless signal, or fingerprint identification. The door preferably faces forwardly and comprises the entire front panel of the safe so as to allow the maximum opening through which to place and remove medications or other items. Of course, other door configurations, like a sliding front door, and other variations will work as well. The safe also has expandable lateral side wings attached to it. The wings expand to fit their side walls flush against the inside walls of the medicine chest. The wings allow the safe to fit tightly inside the medicine chest and therefore make it difficult for another to remove. In many embodiments the safe involves two wings, one that expands to the left side of the larger container or medicine cabinet and one that expands to the right. Other embodiments might also contain wings that expand upwardly or downwardly to ensure that the safe is as secure in its position within the medicine cabinet as possible. The wings might also overlap or interlock behind the safe to create more space for longer wings. Ideally, the wings are also shaped in such a manner so as to catch on the surroundings if moved. For example, the wings might be L shaped such that if the safe and wings are moved forwardly, the perpendicular and forward extension of the wings will catch on the lip of the side walls of the medicine cabinet and make it nearly impossible for the safe to move outwardly any further. The wings should be compressible to a size no larger than the body of the compartment so that the safe, even with wings attached, are compact and can become as small as possible while traveling. Then, when the user is ready to secure the safe in a new location, he can expand the wings one more time to relocate and lock the same. In order to maintain the chosen width, the wings should involve a mechanism that fastens them in place, such as a screw. In some embodiments, the length of the wings can be locked so that the wings can only be repositioned by the safe's owner who can selectively unlock not only the front door of the safe but the lateral extension of the wings. This can be by a lock, screws, or other mechanism. In a further embodiment, the wings can lock and unlock in sync with the locking and unlocking of the safe's door.

In the preferred embodiment, the safe is made of durable yet lightweight material, such as plastic, that prevents the safe from being broken into, yet still makes the safe light enough for travel. The safe should also preferably be made of an opaque material that prevents third parties from knowing what is inside the safe and therefore maintaining the privacy of the owner. Preferably the safe has a simple mechanism for easily and manually expanding outwardly the extension of the lateral wings and then returning them to the compressed position when a relocation of the safe is desired.

DETAILED DESCRIPTION OF THE DRAWINGS AND PREFERRED EMBODIMENTS

Figure 1:
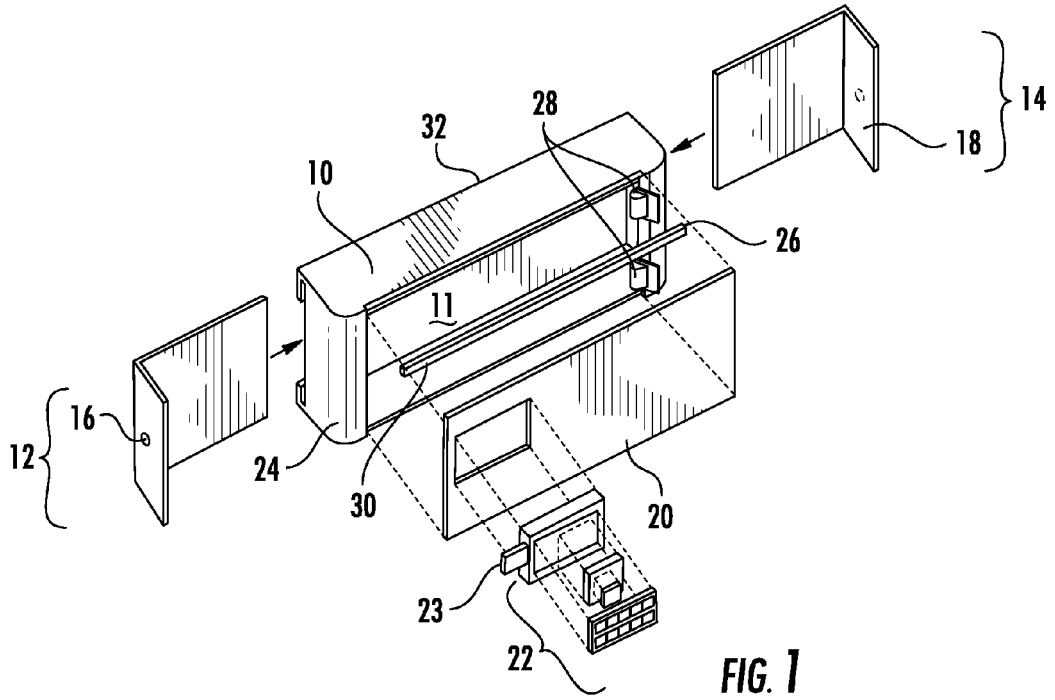
FIG. 1 is an exploded view of the preferred embodiment of the invention, a rectangular safe with adjustable lateral wings that is able to fit inside of a medicine cabinet.
Figure 2:
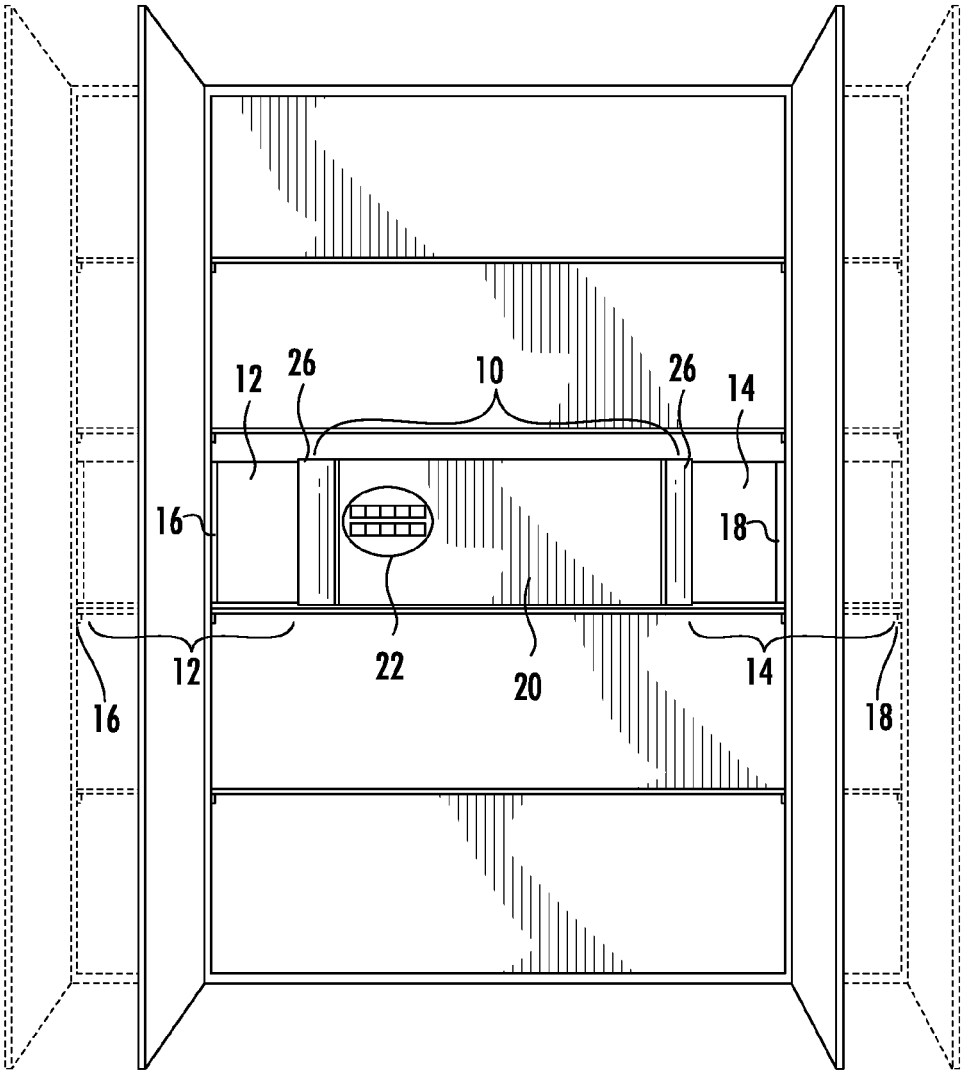
FIG. 2 is a front elevational view of the preferred embodiment of the safe secured inside of the chosen location, in this situation a medicine cabinet. The dotted lines of the further expanded lateral wings represent the same embodiment of the safe secured in a slightly wider medicine cabinet and illustrate the invention's ability to expand to a required width.
Figure 3:
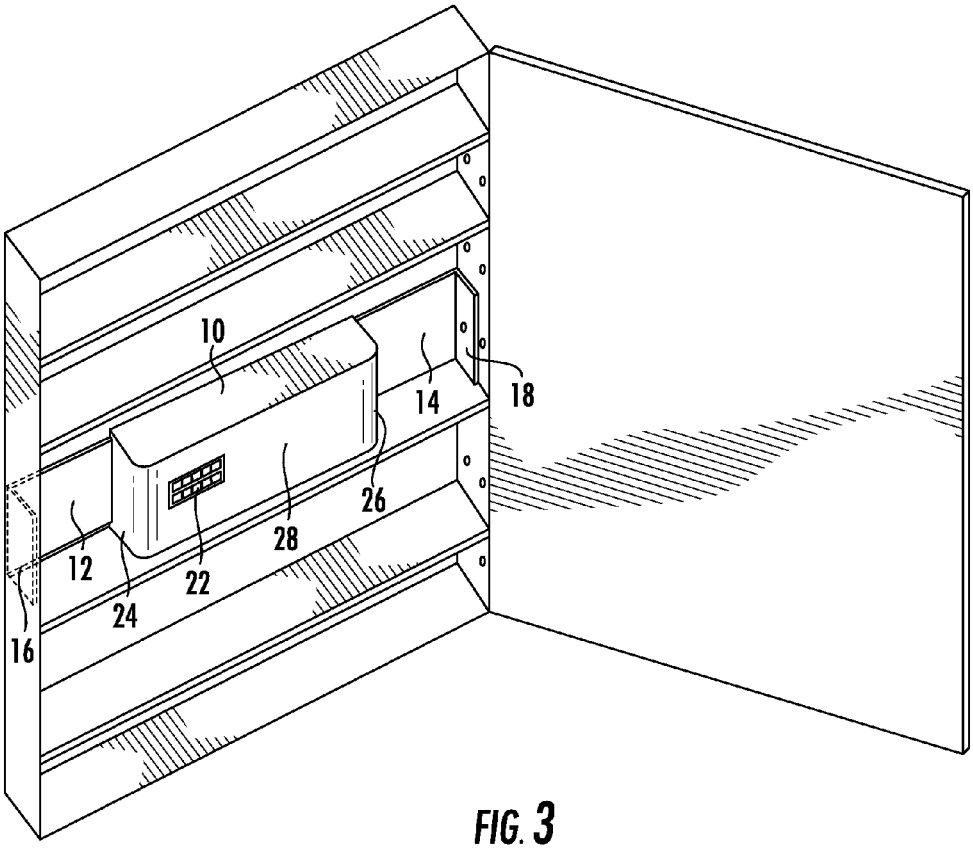
FIG. 3 is a perspective top and front view of the preferred embodiment secured in the chosen location, in this situation a medicine cabinet with a front door.

Description will now be given of the invention with reference to the attached FIGS. 1-4. It should be understood that these Figures are exemplary in nature and in no way serve to limit the scope of the invention, as the invention will be defined by the claims, as interpreted by the Courts in an issued U.S. Patent.

As can be seen from the Figures, the invention relates to a secure holding compartment or a safe, preferably made of strong, opaque and lightweight material, possibly a plastic, used for storing and protecting medicine bottles, medications, and other miscellaneous items. Safe 10 is preferably a box-like or parallelpiped shape made up of two side walls in addition to top and bottom walls, front and back panels, and an openable front door. Other shapes, such as an oval or cube-shaped safe will suffice as well although appropriate modifications will be required. Alternative materials such as aluminum, other light weight metals, or plexiglass will also suffice in the preferred materials for forming the invention. It is preferred that the safe is made of an opaque material, though, to prevent others from seeing the potentially private items in the safe. This quality can be essential for many individuals who want to keep their medications and personal items private from others. For example, some individuals are embarrassed by the medical condition indicated by a medication and would prefer that others not know or suspect that the individual has the condition. Other individuals might worry that if friends or family members saw the medications that they are taking, that their friends and family would be concerned for their health. These individuals will want to keep medications private to prevent others from meddling or worrying. Still others might simply like to maintain their privacy, whether or not they are embarrassed or concerned. In these situations the private, opaque material will be very effective.

Also, considering that liquid and cream medications can spill and some, such as those with acidic pH, will corrode many materials, it will be further advantageous for the safe to be comprised of a material that is easy to clean and one that is resistant to chemical corrosion. This characteristic is especially important for embodiments which are likely to be stored in a medicine cabinet for extended periods as many people keep corrosive materials in the bathroom and medicine cabinet as well. These corrosive materials include items such as nail polish remover, rubbing alcohol, and harsh cleaning supplies. In those situations, a durable material will ensure that the safe can withstand a spill or other accident, whether inside the safe or outside the same.

In the preferred embodiment, the front wall 20 is removable or hinged and forms the door of the safe. It is connected to safe 10 by hinges 28 and can be opened and closed as required. Alternatively, the access door 20 may be made up of a smaller portion of the wall connected to the front wall. One skilled in the art will recognize that there are many options for door 20, but that a larger opening is preferred to allow storage and removal of larger items, and therefore the door preferably comprises nearly the entirety of front wall 20. Of course, when the door 20 is open, the user can place medicine, containers, bottles and other items into the compartment 11 of the safe 10 and seal them inside by closing door 20. For security reasons, door 20 is preferably kept in place by a locking mechanism and can only be opened by the safe's authorized owner. The locking mechanism 22 can be in the form of a physical key, a turnable combination lock, or a padlock (the door having a clasp which connects to the side wall of the safe). All of these options will keep the door locked and closed and allow it to be opened only by those with the authority to do so. In more advanced embodiments, opening, locking and closing the safe can be electronically performed and door 20 can be locked and unlocked by a wireless signal originating from a wireless network or a radio or Bluetooth device. In these embodiments, the safe can even be connected to the "internet of things." Then a user can unlock the safe by phone (local or remote), computer, or other device, whether the user is near or far. The internet of things has many advantages. For example, many electronically controlled devices have an emergency override option which enables third parties, such as a paramedic or caretaker, to access the device even if he or she does not have the initially required authority or credentials. It can also be controlled by a doctor, nurse or other caretaker. In the situation of the preferred embodiment where the safe contains medications, this override option can be lifesaving. If the safe's owner is unconscious, for example, and the medication is locked in the safe, emergency medical care will not be able to open a lock operated by a key or a combination, but might be able to override the electronic lock via an emergency option on a smart phone or the owner's smart phone or wireless network. It also makes the safe easier to access by the user because it eliminates the need to carry a key or memorize a combination. The user can simply unlock the safe using software in the form of an app or other method for communicating. This can save time in a person's routine, or make mistakes such as losing a key no longer life or health threatening. Alternatively, the lock can be controlled by a fingerprint scanner, iris recognition, or other identifying information, such as recognizing the presence of a nearby authorized device. These embodiments, too, will make the safe easier to use in an everyday routine and create extra security against a lost or stolen key, combination, or an electronically connected device. In the embodiment of the illustrated invention, the locking mechanism 22 operates a slidable bar or latch 23 which is received in a slot (not shown) in a side member adjacent the door to secure the front door 20 flush to the front wall. When the locking mechanism 22 is opened, the bar or latch 23 slides out of the slot and the front door can be hingedly opened to provide access.

Figure 4:
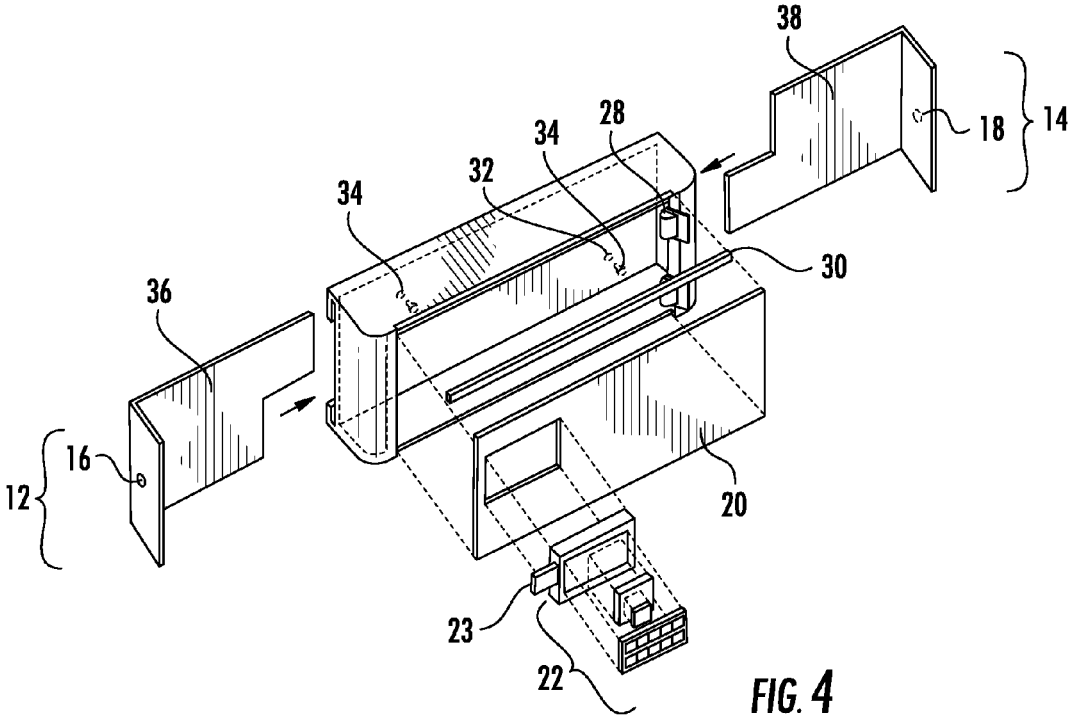
FIG. 4 is an exploded view of an alternative embodiment of the invention, a rectangular safe with adjustable lateral wings that is able to fit inside of a medicine cabinet.

The safe also has preferably a pair of laterally expandable wings 12 and 14 on either side as seen in the Figures. In other embodiments, the safe might also have a wing that expands upwardly, downwardly, or both, too. One wing may be sufficient but two provides greater potential overall width and allows the safe to be centrally positioned in a medicine chest or cabinet. The expandable wings laterally expand to elongate the width of the safe or cabinet structure so that it can adjust to the inside of the enclosure. This adjustment allows the safe to become roughly the same width size as the distance between opposed inside walls of the enclosure (the medicine cabinet) and therefore the safe is locked in place and more difficult to remove from its placement. In preferred embodiments, the wings interlock as in FIG. 4 or overlap as in FIG. 1 when in the compressed position so that each can be longer than simply half the width of the safe. For example, the section of wings 12 and 14 which are parallel to the safe and which lay behind the safe when the wings, labeled 36 and 38 in the Figures, are compressed might be in an L-shape and upside down L-shape, respectively as seen in FIG. 4. This way, when the wings are compressed, they will fit together to lay flat against the safe, but will have a longer range when expanded, and thus be able to be secured in a wider range of cabinets. The wings can be adjusted manually either by the user expanding the wings himself or by a built in lateral expending mechanism secured mechanically to the wings. For example, one embodiment might use a central gear (inside the compartment of the safe) to expand the wings where the gear is attached to the wings such that when the gear is rotated the wings slide out or in, depending on the direction of the gear's rotation. The wings should lock in position to ensure that a thief cannot simply move the wings to remove the safe. In the construction of a gear, or where a similar mechanism is used to expand the wings, the mechanism should be within the cavity of the safe so that the user with the authority to open the safe is also the only one with the authority to move the wings which means that only that person can easily remove the unit. The wings can be locked by a number of methods as well. For example, they too might lock with a key, a combination, or an electronic lock. In FIG. 4, the wings are secured by screws 34. The screws can puncture both the back wall of the safe and the wings, so that the wings are not able to move. Alternatively, the screws can puncture only the back wall of the safe if they are positioned at point beyond the wings and extend far enough past the back wall such that a wing will come in contact with a screw when the wing is compressed. In these situations, the screws will prevent the movement of the wing. Preferably, the screws are in the cavity of the safe and extend to its exterior. This ensures that the wings can be adjusted only by someone with the authority to open the safe. In some embodiments, the wings might only be unlocked when the door 20 is unlocked. In these embodiments, the locking mechanism for the wings might be inside the safe's compartment, or it might be either mechanically or electronically connected to front lock 22. Preferably, wings 12 and 14 are shaped in such a manner that they grip or catch onto the safe's enclosure and make it impossible to move when locked in place. For example, in the present embodiment where the safe is kept in a medicine cabinet, many medicine cabinet walls have an inwardly directed front lip that is used for installing shelves or keeping the cabinet door closed. In this example, it is advantageous to have each of the wings of the safe be L-shaped so that one side is against the back of the cabinet, parallel to the back panel of the safe and the extensions 16 and 18 are perpendicular to both the back section of the wing and to the interior lip of the cabinet. Then, if someone tries to remove the safe by simply pulling the safe forwardly, the wings become caught on the lip of the cabinet and the safe will not move any farther forward. In some embodiments, a user might further or instead secure the wings to the side wall of the medicine cabinet via a screw or other tool that connects the wall of the wing and the wall of the medicine cabinet. Some users might prefer to secure the medicine cabinet without tools as well and therefore secure the invention with double sided tape, foam, glue, or other method that will adhesively connect the wings of the invention to the side walls of the medicine cabinet. Alternatively, the wings might be T-shaped or U-shaped, but the L-shape is preferred as, in that embodiment, part of the wing is at the back of the cabinet and therefore provides space for additional items not in the safe to sit on the same shelf in the medicine cabinet. It is important that the wings can expand to the full length of the enclosure (the medicine chest) to ensure that the safe is not easily removed except when the locking mechanism of the wings is "open" or unlocked.

One skilled in the art will appreciate that the inwardly and outwardly expandable wings allow the safe to be easily removed from the medicine cabinet or other surrounding when the wings are unlocked. The wings can compress to a similar width as the box or cabinet of the safe and remain compact for traveling. Then, the wings can be expanded again to fit into a new medicine cabinet or enclosure. This advantage makes the device easy to travel with and allow its user to easily take the safe when he leaves the house, keeping his medications secure wherever he goes.

The invention can contain further improvements as well. For example, in one embodiment, the interior compartment of safe 10 might also include lighting strip 30 that provides lighting to the compartment to help users see more clearly. As another example, a further embodiment might also include an interior shelf to help organize the contents of safe 10. Also, the rear wall of the safe can be provided with a simple aperture for a screw to pass there through and into the rear of the medicine cabinet to hold the safe securely to the rear wall of the medicine chest, access to the screw only being provided when the safe's front door is unlocked.

Further, the safe can be used for items other than medication. For example, it can protect money, jewelry, or important documents—like passports and visas. Since the safe protects items but is easily removable by the owner, using the invention for money, jewelry, and documents is ideal for travelers. In yet another embodiment, the safe is connected to a wireless network and is able to record when the safe is opened and closed and when the wings are readjusted. In this embodiment, the safe is also able to upload this information to a smartphone app or to a cloud account and save this information for the user or a caretaker to view at a later time. This information can be sent and updated in real time to allow for real time monitoring and data analysis. For example, the invention can record when the safe is opened to make sure that the user is accessing and taking his medication everyday, or as directed. This feature could also provide real time theft detection as well as the device could constantly monitor the opening and closing of the safe's door and, in embodiments equipped with GPS technology, the safe's location. The safe can also include a system for monitoring drug use, such as sensor that records if a certain pill bottle has been removed from the safe or if the pill bottle has been opened. The safe can store this information and forward it via a wireless signal to a doctor or pharmacy, for example. This feature will be useful to inform the doctor or pharmacist about the patient's medication use and advise about when refills are needed or if a prescription should be discontinued. The safe might also have a camera attached in, on top of, or in the vicinity of the safe to photograph users and provide surveillance. The camera might take a photograph or video each time the safe is opened, for example, or each time a person attempts to unlock it to record who is accessing the safe.

Furthermore a software application for a smart phone or computer can be provided which integrates to the timed locking and unlocking mechanisms of the safe's internal compartment and wings. The same application can possibly also provide medication information, including dosage, side effects, instructions, cautions, and more.

In one embodiment, the lateral wings have internal extensions within the safe's compartment, having a rack like configuration which mate with the gear teeth of a knob within or extending outside of the safe. Turning of the knob (which preferably is only unlocked when the door is opened) allows the user to engage the teeth of the gear with the racks of the extensions of the lateral wings to allow the same to slide out and in with respect to the side walls of the safe and to thus engage and contact against the internal side walls of the medicine chest. Of course, other mechanical embodiments can be designed to accomplish a similar purpose.

What is claimed is:

1. A safe for storing medications comprising:

an interior compartment large enough to hold one or more conventional sized bottles or containers of medications, a closing and lockable door capable of securely enclosing said interior compartment and alternatively allowing access to said compartment when said closing and lockable door is opened;

at least one laterally extending and adjustable side wing attached to said safe and laterally movable only when said door is opened and extending from a first- inward, proximal position, close to said interior compartment to a second and outwardly lateral extending position to effect a change in the overall width of said safe and said extending wing;

wherein said side wing is adjustable yet lockable to a variety of widths for securing said safe into a many medicine chests or cabinets of varying widths without the use of tools.

2. A safe as claimed in claim 1 wherein said compartment and wings are made of a lightweight, non-transparent material.

3. A safe as claimed in claim 1 wherein said front door contains a lock mechanism controlled by a device wirelessly connected and controlled by a wireless network.

4. A safe as claimed in claim 1 where said safe comprises a pair of side wings, one of said pair extending from each and opposing sides of said compartment.

* * * * *